United States Patent [19]

Rudd

[11] 4,354,285

[45] Oct. 19, 1982

[54] FACE SHIELD AND HELMET

[75] Inventor: Thomas H. Rudd, Wayzata, Minn.

[73] Assignee: Drag Specialties, Inc., Minneapolis, Minn.

[21] Appl. No.: 194,004

[22] Filed: Oct. 6, 1980

[51] Int. Cl.[3] ..... A61F 9/04; A42B 3/02

[52] U.S. Cl. ..... 2/424

[58] Field of Search ..... 2/424, 10, 9, 6

[56] References Cited

U.S. PATENT DOCUMENTS

| | | | |
|---|---|---|---|
| 2,686,912 | 8/1954 | Shipman | 2/9 |
| 3,548,410 | 12/1970 | Parker | 2/10 X |
| 3,774,239 | 11/1973 | Kotzar | 2/10 |
| 4,117,553 | 10/1978 | Bay | 2/10 |

FOREIGN PATENT DOCUMENTS

| | | | |
|---|---|---|---|
| 1526574 | 9/1978 | United Kingdom | 2/424 |

*Primary Examiner*—Peter P. Nerbun

*Attorney, Agent, or Firm*—Sigalos & Levine

[57] ABSTRACT

A face shield for a helmet comprising a curved panel, at least a portion of which is transparent, for use in an overlying relationship to the face of the user and a V-shaped groove extending upwardly and rearwardly about the face shield from a point near the bottom of the front of the face shield whereby the flow of air through the groove tends to exert a downward pressure on the face shield.

14 Claims, 5 Drawing Figures

FACE SHIELD AND HELMET

BACKGROUND OF THE INVENTION

This invention relates generally to a face shield structure for use in conjunction with a helmet.

A great many motorcycle riders wear helmets because of laws passed by the various government levels. In order to protect the riders from the dangers encountered by air striking the face of the rider, and the possibility of trash, debris or the like striking the face of the rider, many different types of face shields have been designed and manufactured. Such face shields generally include a curved, transparent member which is fixed to the helmet with the bottom edge thereof open so that the helmet and attached face shield can be mounted over the head of the rider.

It is well known that when wearing such a helmet, a substantial upward lift is exerted on the helmet by the wind when traveling at relatively high speeds. Helmets have been designed which have an airfoil incorporated thereon to eliminate the air lift normally exerted on the helmet by using well-known aerodynamic principles, thus providing the wearer with a helmet and face shield which provides better air penetration while forcing the helmet onto the head instead of producing lift. However, such helmets generally have the airfoil formed in both the face shield and the helmet and is formed with an upwardly facing offset flange or ledge which curves or inclines upwardly and rearwardly and gradually decreases in width. This creates special costs in designing the helmet and if the face shield is utilized with a different helmet that does not have such a ledge constructed or formed thereon, a space exists between the face shield and the helmet because of the design of the ledge formed in the face shield. Further, prior art face shields are attached to the helmet in a rigid relationship thereto which necessitates the removal of the helmet and face shield when the user or wearer is conversing with others.

The present invention utilizes a V-shaped in cross section groove, the bottom surface of which forms a straight line extending upwardly and backwardly in a common plane about the sides of the curved face shield. The air flow through the V-shaped groove tends to exert a downward pressure on the face shield, thus relieving upward pressure on the helmet from air pressure which causes neck and back fatigue. An attachment band is positioned inside of, pivotally fastened to, and curved to substantially match the upper portion of the face shield and has fasteners attached thereto for fastening the face shield to a helmet in such a manner that the face shield may be moved about the pivots upwardly and away from the face of the user while it is attached to the helmet. The depth of the V-shaped groove decreases uniformly from the front of the face shield to the back to provide for a smooth flow of air and create a force tending to hold the helmet onto the head. A plurality of air vents are positioned in the top of the V-shaped groove toward the front of the face shield to enable the user to receive air and to allow communication with the face shield in place. Further, these air vents relieve the pressure within the helmet and, combined with the aerodynamic shape of the helmet, cause ordinary high level wind buffeting noise to be almost non-existent. Also, the unique indirect air intake system feature of this invention results in a shield which is exceptionally and substantially noise free and provides the wearer with a constantly controlled fresh air supply which keeps the inside of the shield substantially free from internal fogging.

SUMMARY OF THE INVENTION

Thus, the present invention relates to a face shield for a helmet which is detachable, pivotable upwardly and away from the face of the user when attached to the helmet, adapted to be attached to any desired helmet and has a V-shaped groove, in cross-section, which tends to hold the face shield, and thus the helmet, down because of air flow through the groove when the rider is moving at a relatively high speed. Thus, the present invention comprises a face shield for a helmet having a curved, transparent panel for use in an overlying relationship to the face of the user, an opaque, curved panel having the top surface thereof curved substantially similar to the bottom surface of the transparent panel and a V-shaped groove connecting the lower surface of the transparent panel at an angle to the upper surface of the opaque panel to form a unitary face shield whereby air flow through the V-shaped groove tends to exert a downward pressure on the shield.

BRIEF DESCRIPTION OF THE DRAWINGS

These and other objects of the instant invention may be had by referring to the following specification and drawings in which like numerals indicate like components and in which.

DETAILED DESCRIPTION OF THE DRAWINGS

Figure 1:
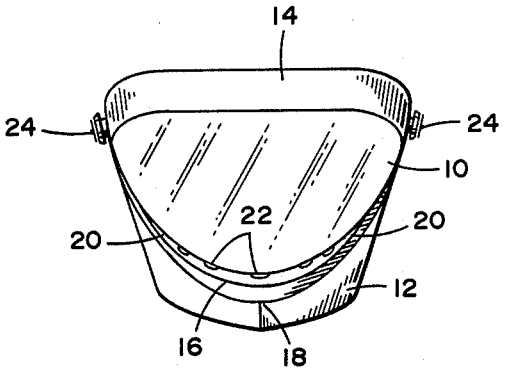
FIG. 1 is the front view of the novel and inventive face shield.

FIG. 1 is a front view of the novel and inventive face shield which includes a curved panel at least a part 10 of which is transparent which overlies the user's face and provides visibility for the user, a first or bottom opaque, curved panel 12 and a second or upper, opaque curved panel 14. A V-shaped groove 16 couples the lower surface of transparent panel 10 at an angle to the upper surface of opaque curved panel 12 whereby air flow through the V-shaped groove tends to exert a downward pressure on the face shield. The lower surface of second opaque curved panel 14 is curved substantially similar to the upper surface of transparent panel 10 and all three panels, the curved transparent panel 10, first opaque curved panel 12, and second opaque curved panel 14 as well as groove 16 are all integrally formed together to form a face shield of unitary construction.

Figure 2:
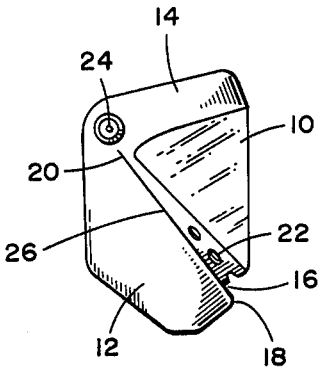
FIG. 2 is a side view of the novel and inventive face shield.
Figure 4:
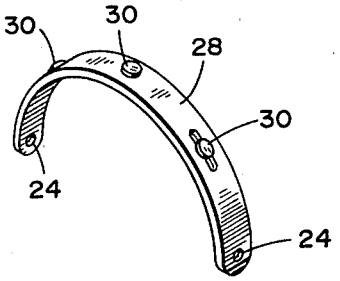
FIG. 4 is an isometric view of the attachment band which is rigidly attached to the helmet and which has the face shield pivotally attached thereto.

As can be seen in FIG. 1, the V-shaped groove 16 extends upwardly and rearwardly about said face shield from a point 18 adjacent the bottom of the front of said face shield. Further, as can be seen in FIG. 1, the depth of the V-shaped groove 16 decreases uniformly from the front 18 of the face shield to the back 20 on either side thereof whereby no groove 16 exists at the back side 20 of the face shield. This design is highly efficient in relieving upward pressure on the helmet caused by air pressure and which results in neck and back fatigue. Further, a plurality of air vents 22 are positioned in the top of the V-shaped groove 16 near the front of the shield whereby air may be received by the user of the face shield. These vents, in combination with the unique aerodynamic shape of the helmet, create a shield in which the usual high level wind buffeting noise created by other shields is virtually non-existent. This is very significant as there is more and more evidence of excessive decibel levels created by most helmets and face shields causing permanent hearing damage. Not only is the shield quiet, but also the vents give the wearer a constant controlled fresh air supply to keep the inside of the shield from internal fogging. Pivotal connections 24 are located on each side of the upper or second opaque curved panel 14 for the purpose of pivotally attaching the face shield to an attachment band which is shown in FIG. 4. As can be seen in FIG. 2, which is a side view of the novel face shield, the bottom 26 of groove 16 forms a straight line extending upwardly and backwardly in a common plane about the sides of the curved face shield. Since the depth of the V-shaped groove decreases uniformly from front to back as shown in FIG. 1, the large shoulder or area at the forward portion 18 has a large amount of air pressure holding the lower end of the face shield down while the decreasing depth of the V-shaped grooves 16 as it moves from the front of the face shield to the back enables the air to move smoothly away from the face shield.

Figure 3:
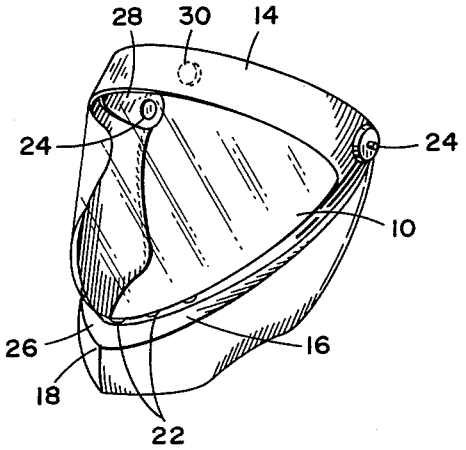
FIG. 3 is an isometric view of the novel and inventive face shield.
Figure 5:
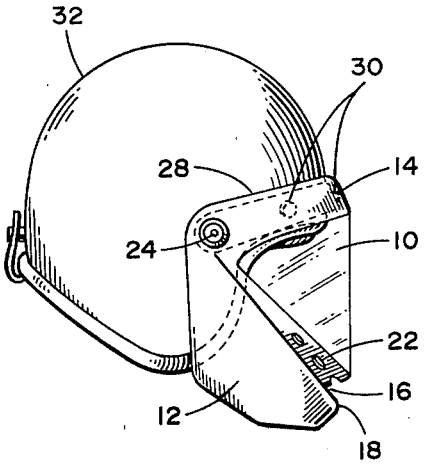
FIG. 5 is a side view of the face shield attached to a helmet.

FIG. 3 is an isometric view of the novel face shield illustrating through the transparent panel 10 the mounting or attachment band 28 (shown in dotted lines in FIG. 5) which is positioned inside of, pivotally fastened to and curved to substantially match the upper portion of the second opaque curved panel 14. A plurality of fasteners 30 enable the attachment band 28 to be securely and detachably fastened to a helmet as shown in FIG. 5. Since the face shield is pivotally attached to the attachment band 28 at pivot points 24, the entire face shield may be lifted up about pivot points 24 and away from the face while the user is still wearing the helmet.

FIG. 4 is an isometric view of the attachment band 28 and, as can be seen, it is curved in the same shape as the forward portion of the helmet to which it is to be attached. Snaps or fasteners 30 detachably fasten to corresponding snaps or fasteners on the helmet. This feature enables the shield to be quickly replaced in the event of scratching of the material or if a different color is desired to be used. The face shield is also attached at pivot points 24 on attachment band 28 and can be moved upwardly and outwardly away from the face of the user when the face shield is pivoted about pivot points 24. When the face shield is in the down position, the V-shaped groove 16, which decreases uniformly from the front to the back of the face shield in an upwardly direction, is held in a downwardly position by the force of the wind against the bottom flat surface of groove 16.

FIG. 5 is a side view of helmet 32 with the face shield pivotally attached thereto at pivot points 24. As seen in relation to FIG. 4, pivot points 24 are associated with the attachment band 28 and are shown in dashed lines in FIG. 5, and wherein a plurality of fasteners 30 associated with attachment band 28 are utilized to fasten the attachment band 28 rigidly to helmet 32.

Helmet 32, of course, is a shell of rigid construction shaped generally in a manner to conform to and fit the head of a user who is normally the rider of a vehicle such as a motorcycle. The helmet may have the usual chin strap assembly and may be provided in any suitable colors. The helmet may be constructed of any suitable relatively lightweight material which is substantially rigid and has the required strength characteristics such as molded plastic material, glass reinforced resin, or any other material from which protective helmets are constructed. Transparent face shield 10 may be constructed of any suitable high impact transparent plastic material or the like, and may be clear or provided with suitable tint characteristics as may be desired. The opaque curved panel 12 and upper opaque curved panel 14 may also be constructed of any suitable high impact plastic material which, in the preferred embodiment, is opaque, but could be transparent if desired.

Thus, the novel face shield disclosed herein not only serves to protect the user thereof from discomfort and possible injury due to air striking the face of the wearer and the possibility of trash, debris or the like striking the face of the wearer, but is also pivotal upwardly and outwardly away from the face of the user without the necessity of removing the helmet. The face shield is held in the downward position by the wind forces in groove 16, which extends upwardly and rearwardly about the face shield from a point adjacent the bottom of the front of the face shield with the bottom of the V-shaped groove in cross-section forming a straight line extending upwardly and backwardly in a common plane about the sides of the curved face shield.

Thus, while the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A face shield for pivotal attachment to a helmet comprising:

(a) a curved transparent panel for the use in an overlying relationship to the face of the wearer of the helmet, (b) an opaque curved panel having the top surface thereof curved substantially similar to the bottom surface of said transparent panel, (c) a groove connecting said lower surface of said transparent panel to said upper surface of said opaque panel, with one surface of said groove extending within a plane, to form a unitary face shield whereby air flow through said groove tends to exert a downward pressure on said shield, and (d) means for pivotally attaching said shield to said helmet.

2. A face shield as in claim 1 wherein said groove is substantially V-shaped in cross section and where the included angle of said V is less than 90°.

3. A face shield as in claim 2 further including:

(a) a second opaque curved panel having the lower surface thereof curved substantially similar to the upper surface of said transparent panel, and (b) means coupling said lower surface of said second opaque panel to said upper surface of said transparent panel to form a unitary shield whereby said transparent panel is formed between said first and second opaque panels.

4. A face shield as in claim 3 wherein said helmet attaching means comprises:

(a) an attachment band positioned inside of, pivotally fastened to and curved to substantially match the upper portion of said second opaque curved panel and to match said helmet, and (b) fasteners attached to said attachment band for fastening said attachment band with said face shield to a helmet whereby when said attachment band is attached to said helmet, said face shield may be moved about said attachment band pivots upwardly and away from the face of the user.

5. A face shield as in claim 4 wherein said V-shaped groove extends upwardly and rearwardly about said face shield from a point adjacent the bottom of the front of said face shield.

6. A face shield as in claim 5 wherein the bottom of said V-shaped groove forms a straight line extending upwardly and rearwardly in a common plane through the sides of said curved face shield.

7. A face shield as in claim 6 wherein the depth of said V-shaped groove decreases uniformly from front to back whereby no groove exists at the back of the sides of said face shield.

8. A face shield as in claim 7 further including a plurality of air vents positioned in the top of said V-shaped groove whereby air may be received by the user thereof, noise may be substantially reduced and the inside of said shield kept free from fogging.

9. A face shield as in claim 8 wherein said first and second opaque panels, said transparent panel, and said V-shaped groove are integrally formed together to create a unitary face shield.

10. A face shield unit for pivotal attachment to a helmet comprising:

(a) a curved panel, at least a portion of which is transparent, for use in overlying relationship to the face of the user, and (b) a V-shaped groove where the included angle is less than 90 degrees extending upwardly and rearwardly about said curved panel from a point near the bottom of the front of said curved panel whereby the flow of air through said groove tends to exert a downward pressure on said panel thereby holding said panel down and relieving upward pressure on said helmet and decreasing the resultant neck and back fatigue.

11. A face shield unit as in claim 10 further including:

(a) a helmet, and (b) means for pivotally attaching said curved panel to said helmet whereby said panel may be moved upwardly about said pivots away from the face of the user but which will tend to be held in the downward position by air flowing through said groove.

12. A face shield unit as in claim 11 further including a plurality of air vents in the top of said V-shaped groove whereby air may be received by the user thereof, noise may be substantially reduced and the inside of said shield kept free from fogging.

13. A face shield unit comprising:

(a) a helmet, (b) an attachment band curved to substantially the same shape as the front of said helmet, (c) pivotal fasteners on each end of said attachment band for detachably receiving a face shield whereby said face shield may be quickly and easily replaced, (d) connections on said attachment band for attaching said attachment band to said helmet, (e) a face shield pivotally and detachably connected to said attachment band pivotal fasteners thereby pivotally mounting said face shield on said helmet, whereby said face shield may be moved upwardly and outwardly about said attachment band pivots away from the face of the user without removing said helmet, and (f) a V-shaped groove having an included angle less than 90° extending upwardly and rearwardly about said face shield from a point adjacent the bottom of the front of said face shield.

14. A face shield unit as in claim 13 wherein the bottom of the V-shaped groove forms a straight line extending upwardly and backwardly in a common plane through the sides of said face shield.

* * * * *